United States Patent [19]

Matsubara et al.

[11] Patent Number: 4,485,280

[45] Date of Patent: Nov. 27, 1984

[54] SWITCH

[75] Inventors: Makoto Matsubara; Hiroshi Tokuyama; Yoshinori Watanabe, all of Furukawa, Japan

[73] Assignee: Alps Electric Co., Ltd., Tokyo, Japan

[21] Appl. No.: 431,378

[22] Filed: Sep. 30, 1982

[30] Foreign Application Priority Data

Jan. 29, 1982 [JP] Japan ..... 57-11904[U]

[51] Int. Cl.[3] ..... H01H 15/00

[52] U.S. Cl. ..... 200/16 C; 200/16 D; 200/277

[58] Field of Search ..... 200/16 B, 16 C, 16 D, 200/275, 277, 11 A, 11 G, 11 J, 11 K, 11 E, 11 EA, 67 AA

[56] References Cited

U.S. PATENT DOCUMENTS

| | | | |
|---|---|---|---|
| 2,226,850 | 12/1940 | Foster et al. | 200/16 C |
| 2,267,427 | 12/1941 | Schmidt | 200/16 C |
| 2,521,468 | 9/1950 | Lodge | 200/16 C |
| 2,837,609 | 6/1958 | Clayton et al. | 200/16 C |
| 3,365,558 | 1/1968 | Cardin | 200/275 X |

*Primary Examiner*—J. R. Scott

*Attorney, Agent, or Firm*—Guy W. Shoup; Gerard F. Dunne

[57] ABSTRACT

A switch comprises a pair of stationary contacts and a movable contact which is fixed to a slider. The movable contact is held in contact with a conductive roller held rotatably to one of the stationary contacts. Upon movement of the slider, the movable contact moves along the rotating roller between positions engaging and disengaging the other fixed contact.

9 Claims, 14 Drawing Figures

SWITCH

FIELD OF THE INVENTION

This invention relates to a switch comprising a pair of stationary contacts and a movable contact contacting said stationary contacts.

BACKGROUND OF THE INVENTION

Heretofore, the type of switch with a vertical section such as that shown in FIG. 1 has been used for lighting the stop lights of motorcycles. This switch has a pair of stationary contacts 2 and 3 in a housing part 1*a*, the ends of the stationary contacts 2 and 3 protruding backwards as terminals 2*a* and 3*a*. Another housing part 1*b* associated with said housing part 1*a* contains a slider 4 having a protrusion normally extending outwardly from the housing, as shown in FIG. 1. The slider is urged in the direction to extend its protrusion out of the housing by a spring 5. A movable contact 6 is fixed on the slider 4, and is urged by a leaf spring 7 in the direction to engage the stationary contacts 2 and 3. The action of the switch is, as shown in FIG. 2, that the movable contact 6 always makes contact with the upper surface of a protrusion 3*b* of one of the stationary contacts 3, and the movable contact 6 either makes contact with the other contact as shown in FIG. 2(A) or separates therefrom as shown in FIG. 2(B) depending on the position of the slider 4. The switch may be considered ON in FIG. 2(A), and OFF in FIG. 2(B).

In this type of switch, however, since the movable contact 6 always slides over the protrusion 3*b* of the stationary contact 3, chattering may occur between the movable contact 6 and the stationary contact 3 during operation. Hence it may be required to provide a chattering compensation circuit within a circuit incorporating this type of switch. Also when such a switch is frequently operated, failure may occur owing to wear of the contacting surface of the stationary contact 3 and the movable contact 6 as shown in FIG. 3. Furthermore, if a large current is supplied to such a switch, the contacting surfaces of the contacts may fuse due to Joule heating.

In a conventional switch of the type illustrated in FIG. 4, a notch 4 is made on the side of the slider 4 and a protrusion 6*a* extends from the side of the movable contact 6. The protrusion 6*a* may be inserted into the notch 4*a* to assemble the slider 4 and the movable contact 6. Therefore, the movable contact 6 may come off during assembly due to the force of the leaf spring 7 (FIG. 5), and it is difficult to assemble such a switch.

SUMMARY OF THE INVENTION

The present invention is, therefore, concerned with solving such problems in conventional switches by providing a reliable switch having a long life with smooth sliding between the movable and stationary contacts, and yet is still free from chattering or wear.

The switch of the present invention has a rotary contact in the stationary contact which makes contact with the movable contact, this rotary contact being provided in place of the protrusion 3*a* in the conventional switch.

The objects of the invention will be apparent from the following description taken in conjunction with the accompanying drawings wherein:

DESCRIPTION OF PREFERRED EMBODIMENTS

Figure 1:
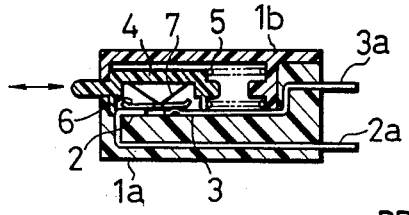
PRIOR ART Fig.1
FIG. 1 is a vertical section of a conventional switch.
Figure 2A:
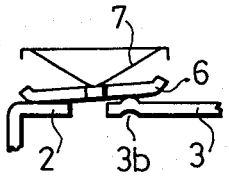
PRIOR ART Fig.2(A)
FIGS. 2(A) and 2(B) are diagrams illustrating the operation of the conventional switch.
Figure 2B:
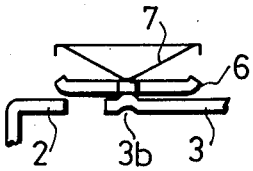
PRIOR ART Fig.2(B)
Figure 3:
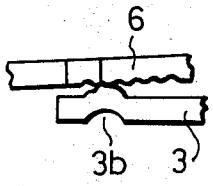
PRIOR ART Fig.3
FIG. 3 is a diagram illustrating the conventional switch when worn.
Figure 4:
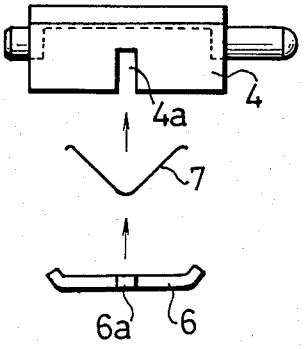
PRIOR ART Fig.4
FIGS. 4 and 5 are enlarged views of the movable contact components of the conventional switch.
Figure 5:
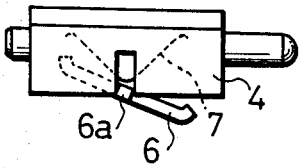
PRIOR ART Fig.5
Figure 6:
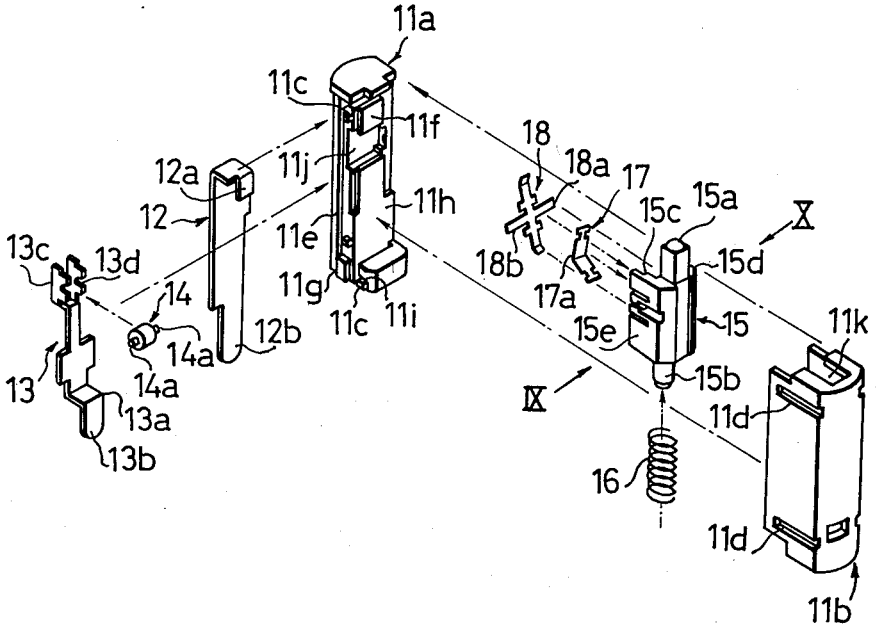
FIG. 6 is an exploded perspective view of a switch fabricated according to this invention.

Referring to the drawings, 11*a* and 11*b* show housing part made of an insulation material. Four protrusions 11*c* are provided on the sides of housing part 11*a*, and four notches 11*d* are provided on the sides of the other housing part 11*b*. By fitting these protrusions 11*c* in the notches 11*d*, housing part 11*a* can be fixed to the other housing part 11*b*. A slot 11*e* is formed along a side of the housing part 11*a*, and a stationary contact plate 12 is inserted into the slot 11*e*. A contacting surface 12*a*, made by bending over one end of the contact plate 12, is fixed to the upper surface of the base 11*f* of the housing part 11*a*, and the terminal 12*b* protrudes from one end 11*g* of housing part 11*a*. The other stationary contact plate 13 is fixed on the front of housing part 11*a*. One end of the stationary contact plate 13 is bent to form a crank 13*a*, and by fitting the crank 13*a* into a groove 11*i* on the side of housing part 11*a*, the stationary contact plate 13 is fixed to housing part 11*a*. The bent end of the stationary contact plate 13 forms the terminal 13*b* which protrudes from the end 11*g* of housing part 11*a*. A support 13*c* is formed at the other end of the stationary contact plate 13. When the stationary contact plate 13 is fixed to housing part 11*a*, the support 13*c* is fitted in the recess 11*j* in housing part 11*a*. A pair of support notches 13*d* are formed on the support 13*c*, and the ends 14*a* of a rotary contact 14 are rotatably supported by these notches 13*d*. The rotary contact 14 is made of the same metal as the stationary contact plates 12 and 13, and is silver-plated on the surface as are the stationary contact plates 12 and 13.

A slider 15 made of an insulation material is contained in the housing part 11*b*. The slider 15 can slide within the housing part 11*b* in the direction shown by the arrow in FIG. 7. An operating pin 15*a* is integrally formed on one end of the slider 15, and it protrudes from a hole 11*k* formed on the housing part 11*b*. A support pin 15*b* is integrally formed on the rear end of the slider 15 and is inserted into a spring 16 contained in housing part 11*b*. The slider 15 is always urged in the direction in which the operating pin 15*a* protrudes from housing 11*b* by the resiliency of the spring 16.

Figure 9:
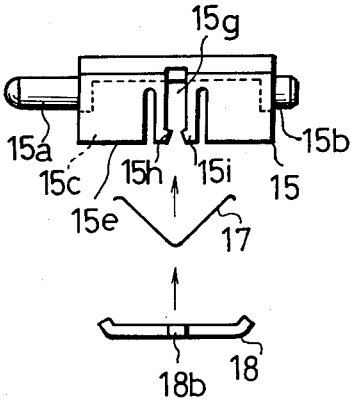
FIG. 9 is a view from the direction IX in FIG. 6.
Figure 10:
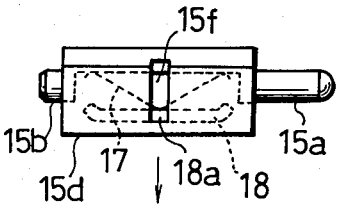
FIG. 10 is a view from the direction X in FIG. 6.

A groove 15*c* is formed on the side of the slider 15 facing housing part 11*a*, wherein a leaf spring 17 and a movable contact 18 are contained. The leaf spring 17 is bent to be V-shaped and the bend portion 17*a* contacts the movable contact 18. The movable contact 18 is formed from the same metal as the stationary contact plates 12 and 13 and the rotary contact 14, and is silver-plated on its surface. As shown in FIG. 10, an elongated hole 15*f* is formed in a side plate 15*d*. As shown in FIG. 9, the other side plate 15*e* has a groove 15*g* and flexible supports 15*i* located on respective sides of the groove 15*g*. The flexible supports 15 have claws on their lower ends. When the leaf spring 17 and the movable contact 18 are assembled in the slider 15, first the leaf spring 17 is inserted in the groove 15*c*, then one arm 18*a* of the movable contact 18 is inserted into the hole 15*f*, and the other arm 18*b* is forced into the groove 15*g*. The arm 18*b* is caught by the claws 15*h*. After the assembly of the leaf spring 17 and the movable contact 18 in the slider 15, the movable contact 18 will not come off due to the resiliency of the leaf spring 17, thus facilitating assembly.

Figure 7A:
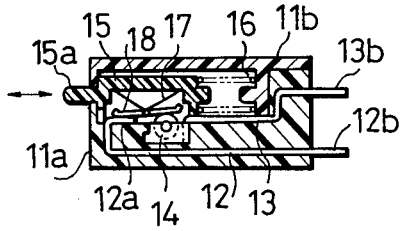
FIG. 7(A) is a vertical sectional view of the assembled switch in the "on" position.
Figure 8:
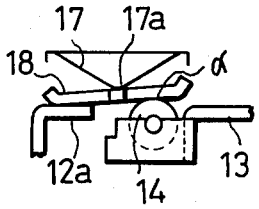
FIGS. 8(A), 8(B) and 8(C) are enlarged views showing the operation of the switch according to this invention.
Figure 8:
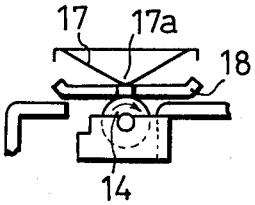
Figure 8:
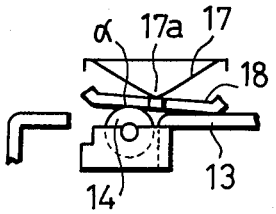

The operation of the switch of the above structure will be apparent from the following description:

FIGS. 7(A) and 8(A) show the on-condition of the switch. Under this condition, no external force is exerted on the operating pin 15*a*, and the slider 15 is pushed to the left in the drawing by the spring 16. In this case, the pressure point on the movable contact 18 by the leaf spring 17, i.e., the bend portion 17*a* of the leaf spring 17, is situated to the left of the tangent point $\alpha$ of the rotary contact 14 and the movable contact 18. The movable contact 18 is, therefore, urged counter clockwise by the leaf spring 17, and makes a sure contact with both the rotary contact 14 and the contacting surface 12*a* of the stationary contact plate 12. Thus the two stationary contact plates 12 and 13 are made to contact through the rotary contact 14 and the movable contact 18, and the switch is turned on.

When the operating pin 15*a* is pushed to the right of the drawing to move the slider 15 to the right, the movable contact 18 also moves to the right together with the slider 15. Since the movable contact 18 is pressed onto the rotary contact 14 by the leaf spring 17, the rotary contact 14 rolls under the movable contact 18 when the movable contact 18 moves to the right. FIG. 8(B) shows the state during the course of the movement of the slider 15 to the right of the drawing. At this time, the bend portion 17*a* of the leaf spring 17 is situated just above the rotary contact 14. Therefore, the movable contact 18 becomes horizontal on the rotary contact 14, and the left end of the movable contact 18 separates from the contact surface 12*a* of the stationary contact plate 12. At this moment, the contact between the two stationary contacts 12 and 13 is broken, and the switch is turned off.

Figure 7B:
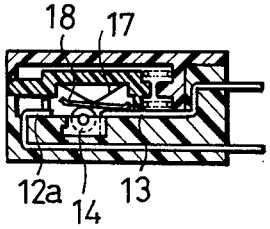
FIG. 7(B) is a vertical sectional view of the assembled switch in the "off" position.

FIG. 7(B) and FIG. 8(C) show the state where the operating pin 15*a* is pressed further to move the slider 15 to the rightmost position in the drawing. In this case, the bend portion 17*a* of the leaf spring 17 shifts to the right of the tangent point $\alpha$ of the rotary contact 14 and the movable contact 18. Therefore, the movable contact 18 is pressed clockwise by the leaf spring 17, and the right end of the movable contact 18 makes sure contact with the stationary contact plate 13. This is the complete off-condition of the switch.

When the pressure on the operating pin 15*a* is removed, the slider 15 returns to the left-end position by the force of the spring 16, and the switch returns to the on-condition.

According to the present invention, since a rotary contact is provided on the stationary contact which always makes contact with the movable contact, so that the movable contact makes contact with the rotary contact through rolling, the action of the movable contact is smooth, and chattering does not occur between the movable contact and the rotary contact. Thus the reliability of the switch is greatly improved. The load on the slider is also reduced because there is no sliding friction between the movable contact and the rotary contact. Furthermore, since the sliding part of the contact does not wear out as happens in conventional switches, the life of the switch is increased.

What is claimed is:

1. A switch comprising a pair of stationary contacts held in spaced relation in a housing and means including a slider mounted slidably within said housing and having a movable contact for holding said movable contact constantly in engagement with one of said stationary contacts and selective engagement with the other stationary contact according to the movement of said slider, a rotary contact and means holding said rotary contact rotatably on said stationary contact held in constant contact with said movable contact, said movable contact engaging said rotary contact.

2. A switch including a first fixed contact having a first contact portion held in fixed position within a housing, a second fixed contact having a second contact portion formed by a conductive roller held rotatably to said second fixed contact, a slider carrying a movable contact, and means urging said movable contact against said roller so that said movable contact can be moved between a first position bringing a portion of said movable contact into engagement with said first contact portion and a second position out of engagement with said first contact portion as said movable contact travels along the rotating roller.

3. A switch according to claim 2, said movable contact having a central portion lying between said first contact portion and said roller in said first position of said movable contact, the peripheral surface of said roller lying above the surface of said first contact portion, and said urging means acting on said central portion so that in said first position said urging means press said movable contact against said first contact portion and during movement towards said second position said movable contact pivots away from said first contact portion as said central portion passes over said roller.

4. A switch according to claim 3, said urging means including a spring fitted between said slider and said movable contact, and said slider having means holding said movable contact in a manner so that it may be moved towards and away from said slider within preset limits.

5. A switch according to claim 4, said holding means including a recess in said slider receiving said movable contact, the side walls of said recess having elongate openings receiving laterally-extending portions of said movable contact.

6. A switch according to claim 5, one of said elongate openings being a slot and the other being a groove opened at its lower portions and having means including claws spaced at its lower portion for allowing a lateral-extending portion to slip within said grooves but preventing easy withdrawal therefrom.

7. A switch according to claim 2, said urging means including a spring fitted between said slider and said movable contact, and said slider having means holding said movable contact in a manner so that it may be moved towards and away from said slider within preset limits.

8. A switch according to claim 7, said holding means including a recess in said slider receiving said movable contact, the side walls of said recess having elongate openings receiving laterally-extending portions of said movable contact.

9. A switch according to claim 8, one of said elongate openings being a slot and the other being a groove opened at its lower portions and having means including claws spaced at its lower portions for allowing a lateral-extending portion to slip within said groove but preventing easy withdrawal therefrom.

* * * * *